United States Patent [19]

Groenig

[11] 4,000,787

[45] Jan. 4, 1977

[54] VEHICLE FOR PICKING FRUIT

[76] Inventor: Robert E. Groenig, 8505 Tieton Drive, Yakima, Wash. 98902

[22] Filed: Sept. 16, 1974

[21] Appl. No.: 506,273

[52] U.S. Cl. ..... 182/2

[51] Int. Cl.[2] ..... B66F 11/04

[58] Field of Search ..... 182/2, 129; 214/83.1; 180/6.48

[56] References Cited

UNITED STATES PATENTS

| | | | |
|---|---|---|---|
| 2,954,092 | 9/1960 | Trump | 182/2 |
| 2,970,667 | 2/1961 | Bercaw | 182/2 |
| 2,973,112 | 2/1961 | Young | 182/2 |
| 2,994,393 | 8/1961 | Whaley | 180/6.48 |
| 3,182,827 | 5/1965 | Frost | 182/2 |
| 3,319,739 | 5/1967 | Morse | 182/2 |
| 3,332,513 | 7/1967 | Wiebe | 182/2 |
| 3,379,279 | 4/1968 | Slusher | 182/2 |
| 3,448,827 | 6/1969 | Clark | 182/2 |
| 3,459,318 | 8/1969 | Clark | 214/83.1 |
| 3,584,705 | 6/1971 | Ruegg | 182/2 |
| 3,631,939 | 1/1972 | Johnson | 182/2 |

*Primary Examiner*—Reinaldo P. Machado

[57] ABSTRACT

The machine disclosed herein is made up basically of a boom mounted on a frame supported by three widely spaced wheels. A platform is attached to the distal end of the boom for supporting an operator and the machine is equipped with hydraulic controls accessible to an operator on the platform. The machine can be steered by the individually controlled drive wheels. A picking bucket is carried by a separate boom connected to the main boom and accessible to the operator on the platform and the picking bucket can be swung over a box supported on the machine frame.

6 Claims, 10 Drawing Figures

VEHICLE FOR PICKING FRUIT

REFERENCE TO PRIOR ART

Various vehicle supported boom arrangements have been provided for picking fruit, for example, machines of the general type disclosed herein are shown in U.S. Pat. Nos. 2,829,814; 3,727,720; 2,469,071; 1,921,583; 3,767,007; 3,572,467 and 635,440.

GENERAL DESCRIPTION OF THE INVENTION

The machine shown has widely spaced wheels which may be made small so that the machine has a low profile for working around small, crowded trees in an orchard. The machine has a self-contained hydraulic drive which allows the machine to go almost anywhere on a farm or orchard, even over ice and snow. The machine eliminates the necessity for ladders or separate power sources for moving the machine about. Because of the structure provided, the machine is fast and easy to operate and the hydraulic drive makes it move gently around trees. The controls allow the operator, when standing on the platform, to start, stop, drive, turn, raise or lower the platform and the picking bucket from the platform cage.

The machine may be equipped with a box or picking bucket. The bin carrier allows the picker to have his bin within easy reach at all times and the picking bucket allows him to stay in position in the tree while the picking bucket is being filled.

OBJECTS OF THE INVENTION

It is an object of the invention to provide an improved orchard machine.

Another object of the invention is to provide an improved vehicle mounted platform.

Another object of the invention is to provide an improved boom supported platform which is simple in construction, economical to manufacture, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions, and minor details of construction without departing from the spirit or sacrificing any of the advantages of the invention.

GENERAL DESCRIPTION OF THE DRAWINGS

DETAILED DESCRIPTION OF THE DRAWINGS

Figure 1:
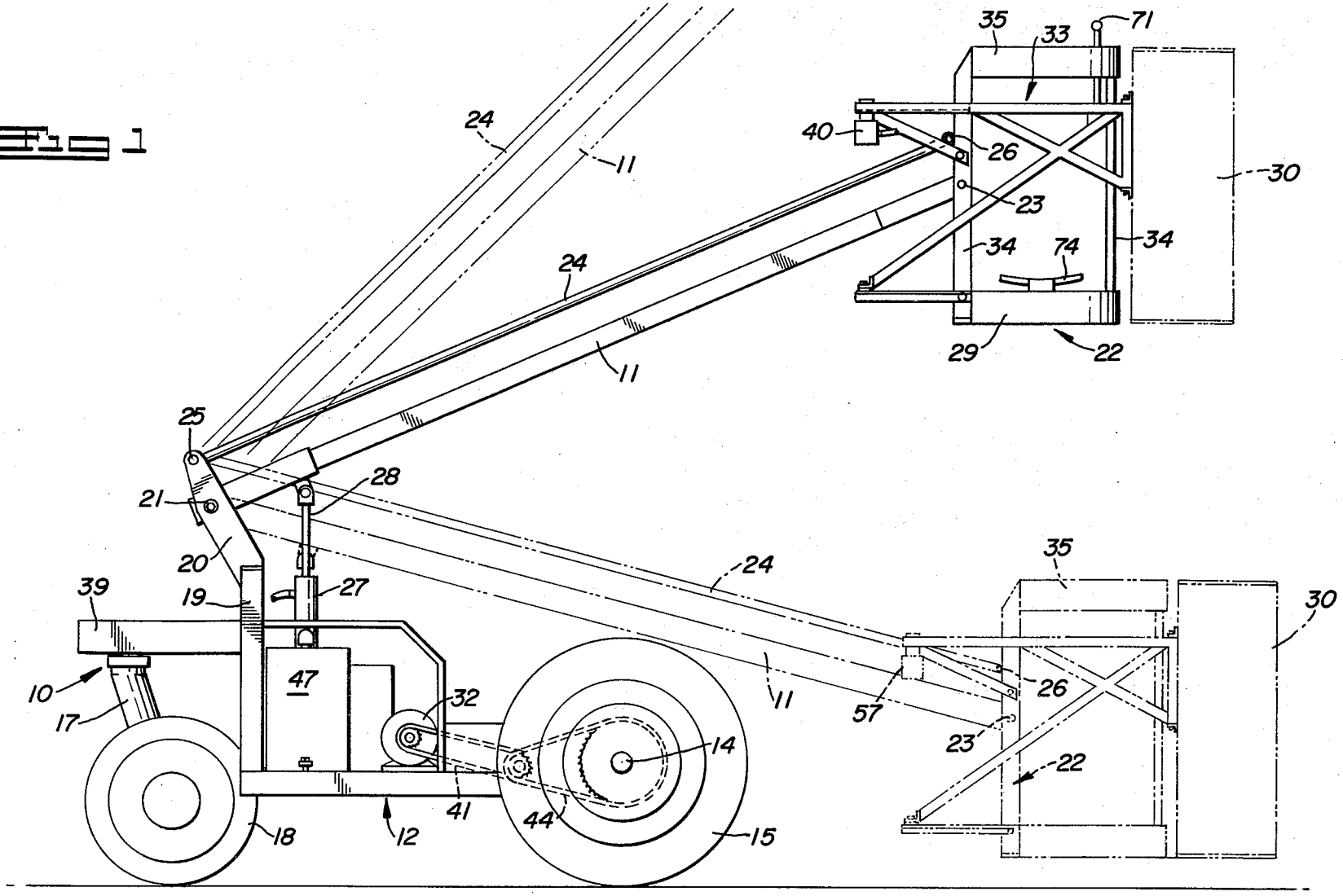
FIG. 1 is a side view of the machine according to the invention.
Figures 2, 3, 4:
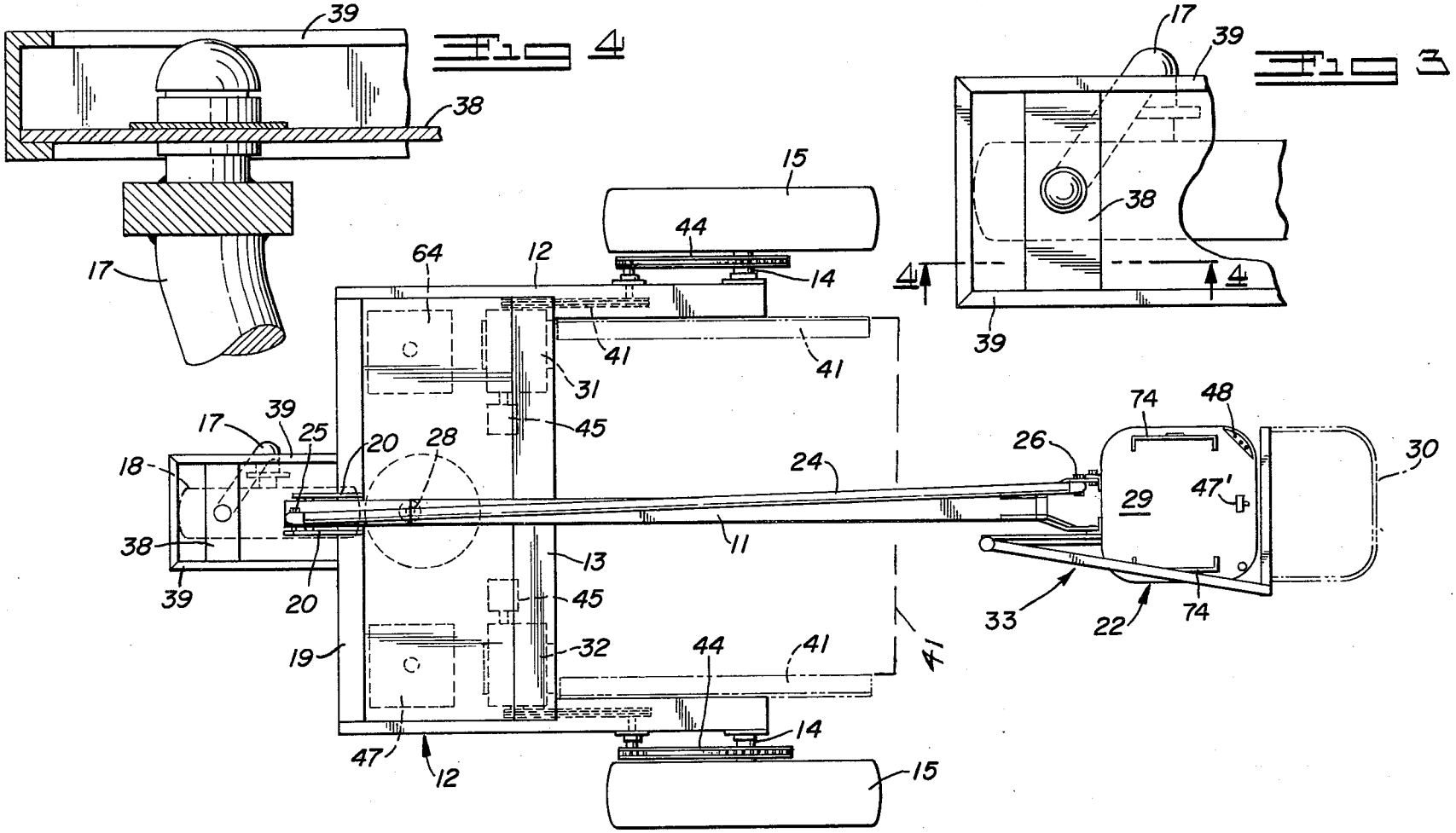
FIG. 2 is a top view of the machine.
FIG. 3 is an enlarged partial top view of the machine.
FIG. 4 is an enlarged cross sectional view taken on line 4—4 of FIG. 3.

Now with more particular reference to the drawings, the vehicle 10 shown has a boom 11 pivotally mounted on the machine frame. The frame is made up of spaced longitudinally extending side members 12 connected by cross member 13 and having the upwardly and inwardly extending frame members 19 fixed to its front end. The frame members 12 extend rearwardly providing a support 40 for a storage box.

The drive wheels 15 are supported on the frame members 12 by axles 14 and 16. The front wheel 18 is supported on a caster mechanism 17 and caster mechanism 17 is supported on the upwardly and inwardly extending frame members 19.

The upwardly and forwardly extending frame members 20 are fixed to the upper ends of the frame members 19 and the front end of the boom 11 is pivoted at 21 to the frame members 20. The link 24 is pivoted at 25 to the frame members 20. The boom is swung up and down by cylinder 27 which is supported on the frame and has a piston rod 28 connected to the boom.

Drive wheels 15 are driven by individual hydraulic motors 31 and 32 through chains 41 and 44.

The cage 22 is supported on the distal end of the boom 11 by brackets 37 and pivots 23. Link 24 is fixed to the upwardly extending member 35 of the cage by pivot 26.

The front wheels of the vehicle are castered. The rear wheels 15 of the vehicle are each driven individually by one of the hydraulic motors 31 and 32. The motors 31 and 32 are driven forward or backward by hydraulic pumps 45 and 46 respectively. Each wheel 15 has a brake 15' which is held engaged by springs 78' and the brakes are released when fluid under pressure is applied to the respective hydraulic cylinders 77'. Hydraulic cylinders 77' are provided with fluid under pressure from pumps 45 and 46' when one of the pumps 45 or 46 supplies fluid under pressure to its particular motor 31 or 32. Thus when one of pumps 45 or 46 supply fluid under pressure to one of the motors 31 or 32, either in a forward direction or a rearward direction, the fluid under pressure flows to the particular cylinder 77 or 77' on that wheel to release the brake on that wheel so that wheel can be driven forward or rearward. When no fluid under pressure is applied to the wheels 15, the springs 78' on that wheel apply the brake so that each of the wheels 15 is locked by a brake 15' when the motor 31 or 32 on that wheel is not being driven. This allows the wheel that is being driven to steer the vehicle around the wheel that is held in position by its brake.

The picking bucket 30 has a false bottom 49 supported on the bracket 50. The bracket 50 has vertically spaced wheels 51 and 52 that are carried in the vertical track 53. The track 53 has a curved part that terminates in a horizontal part at its lower end and is disposed at 90° to the vertical part. The bracket 50 is pulled up and down by a cable 54 connected to the piston of the hydraulic cylinder 55. The cylinder 55 receives fluid from the pumps 56 in a direction controlled by the valve 57 which is manually operated by the operator through control 58 through the lines 59 and 60 so that the piston in cylinder 55 through the cable 54 pulls the bracket 50 up and down and, with it, the bottom 49 of the picking bucket 30 so that the bottom 49 can be moved from the position 49 to the position 49' and the bracket 50 can be moved from its position to the position 50′ with its wheels 51 and 52 in the positions 51′ and 52′ respectively.

The boom 11 is moved up and down by the hydraulic cylinder 27 through the piston rod 28. The bucket may be supported on the second boom 33.

The boom 11 is moved up and down by the four-way valve 61 of a type familiar to those skilled in the art and controlled by a control 74. The valve 61 is supplied fluid under pressure from pump 56 which moves the piston in the cylinder 27 up or down depending on the position of the handle 74.

The control for the motors 31 and 32 is made up generally of a pivot bar 62 supported on the vehicle and rotatable about its longitudinal axis in bearings 63 and 64. The pivot bar 62 is received in the tubular part 65 of the pivot 66. The pivot 66 is T-shaped and has a forwardly extending pin 67 fixed to it and the tubular part 65 is located on pivot bar 62 by the collars 67′ which are fixed to the pivot bar 62 by set screws 68.

Tube 69 receives pin 67 and rotates between cotter pin 70 and tubular part 65. Both handle 71 and rod holder 72 are fixed to tube 69. Handle 71 extends up and rod holder 72 extends laterally. Rod ends 73 are pivoted to the ends of rod holder 72. Thus by grasping the handle 71, the operator can swing rod holder 72 about pivot bar 62 thereby moving rod ends 73 together and driving motors 45 and 46 in a single direction. The operator can rock the handle around pin 67 to move either of rod ends 73 individually either forward or rearward.

Figure 6:
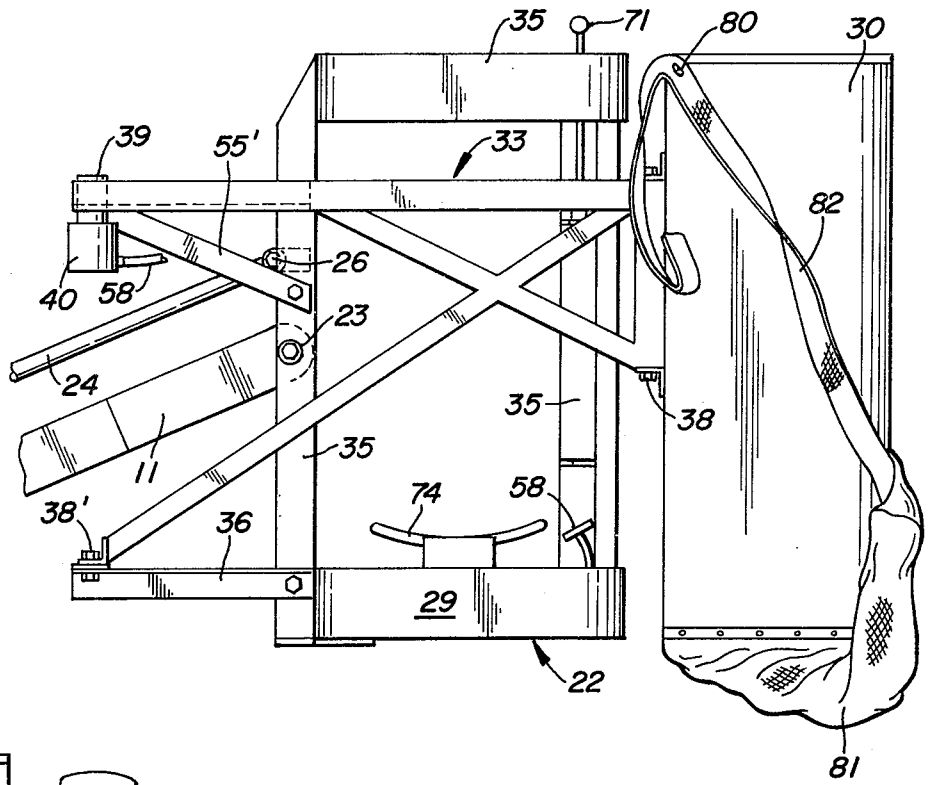
FIG. 6 is an enlarged partial side view of the platform supported on the boom.
Figure 5:
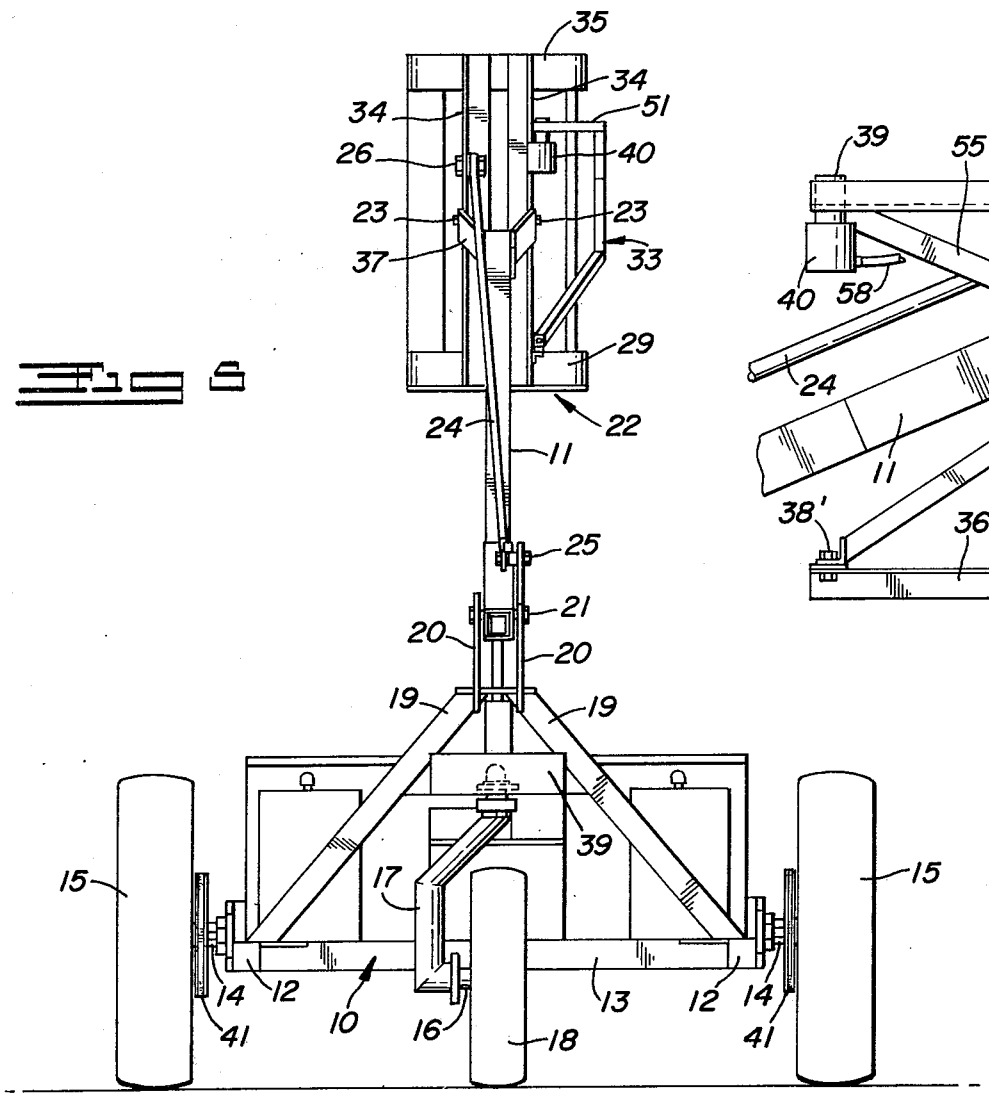
FIG. 5 is a front view of the machine according to the invention.
Figure 7:
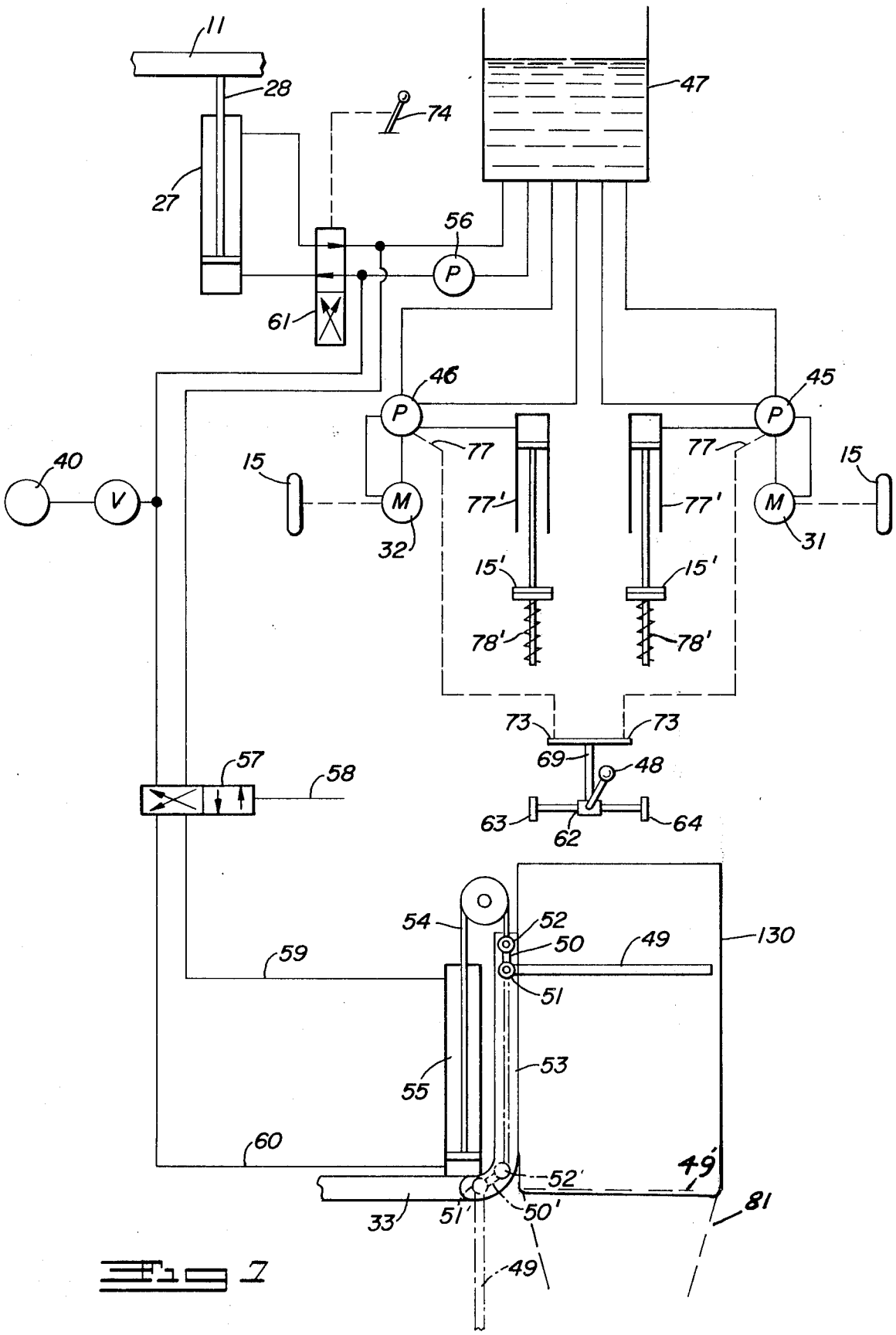
FIG. 7 is a schematic hydraulic diagram.
Figure 8:
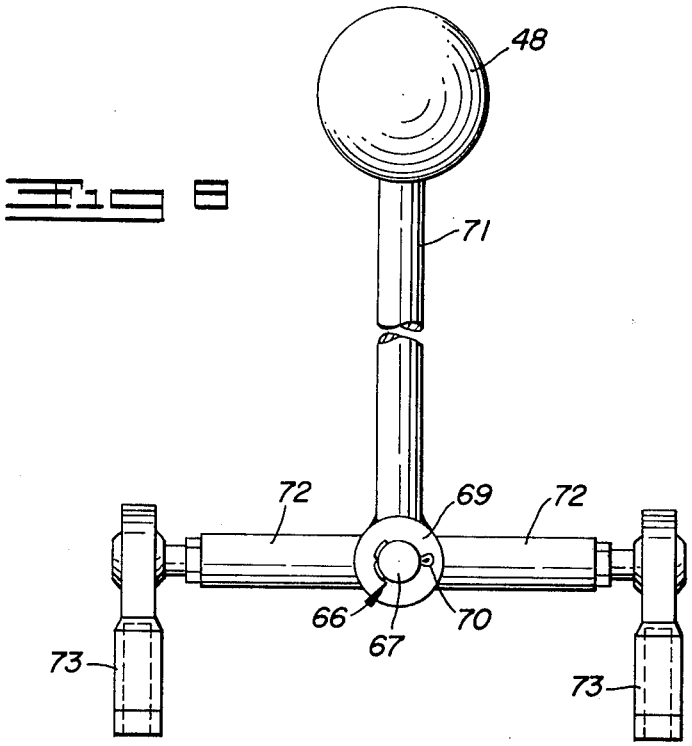
FIG. 8 is an enlarged front view of the control actuator.
Figure 10:
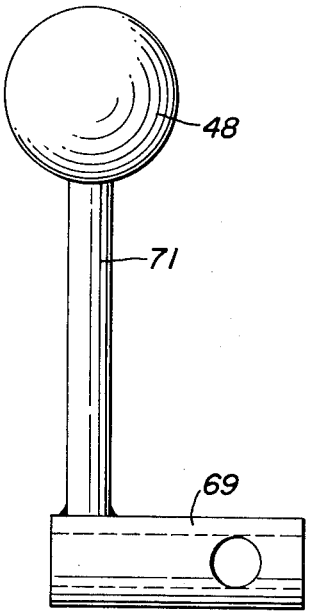
FIG. 10 is an enlarged partial view of the handle for the control actuator.
Figure 9:
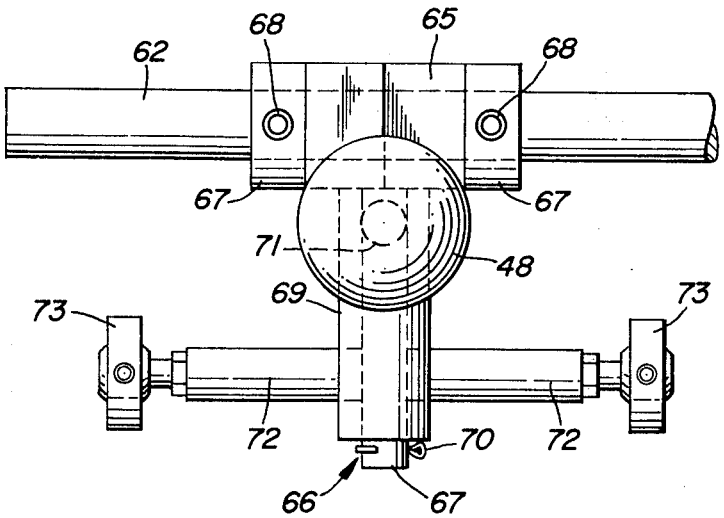
FIG. 9 is a top view of the control actuator.

The picking bucket has a flexible funnel 81 connected to its lower end and a strap 82 is connected to the funnel adjacent the opening 84 in its lower end so that the funnel can be held up in position shown in FIG. 6 or the strap may be released so that the funnel will allow fruit to flow into a bin 41′ supported on frame members 41.

The foregoing specification sets forth the invention in its preferred practical forms but the structure shown is capable of modification within a range of equivalents without departing from the invention which is to be understood is broadly novel as is commensurate with the appended claims.

The embodiments of the invention in which an exclusive property or privilege is claimed are defined as follows:

1. A machine comprising a frame, said frame having an intermediate part and two spaced rearwardly extending rear parts,
a caster wheel fixed to said forwardly extending part,
rear wheels fixed to said rearwardly extending parts,
a boom pivoted to said frame above said caster wheel and extending rearwardly therefrom,
a cage fixed to the distal end of said boom,
link means disposed generally parallel to said boom connected to said frame and to said cage whereby said cage is held to move in a vertical direction,
means for swinging said boom up and down,
and means accessible to a person in said cage for driving said wheels and steering said vehicle,
and an auxiliary boom is supported on said boom to swing about a vertical axis,
wherein said auxiliary boom is swingably supported on said cage,
a picking bucket is supported on said auxiliary boom.

2. In combination, a vehicle and a boom,
said vehicle having a frame,
said frame comprising a longitudinally-extending frame part,
spaced rear axle members fixed to the rear portions of said longitudinally-extending frame part,
and rear wheels on said rear axle members,
front axle caster means supporting said front axle on said longitudinally-extending frame part,
a front wheel supported on said front axle,
a vertically-extending frame member fixed to said longitudinally-extending frame part,
means extending upwardly and forwardly from said frame and supporting said caster,
first pivot means pivotally supporting said boom on said upwardly-extending frame member,
a cage pivotally supported on the second end of said boom,
and link means connected from said frame to said cage for maintaining said cage in proper position,
and means to individually and selectively drive said rear wheels whereby said vehicle may be steered,
said rear axles being spaced from each other a distance substantially equal to the spacing of said front axle to a line passing through said rear axle,
and means for supporting a fruit bin between said rear axles,
first hydraulic cylinder connected to said vehicle and said boom for swinging said boom up and down,
hydraulic motor means for driving the wheels of said vehicle,
and second hydraulic cylinder means connected to said frame for steering said vehicle,
said hydraulic motor means and said hydraulic cylinder means being operable from controls fixed to said cage and accessible to said person in said cage.
a second boom,
said second boom being swingably connected to said cage about a vertical axis,
a picking bucket supported on said second boom, hydraulic pressure means for swinging said second boom relative to said cage.

3. The combination recited in claim 2 wherein control means is mounted on said platform whereby an operator can selectively control said rear wheels to drive said rear wheels and thereby steer said vehicle.

4. The combination recited in claim 2 wherein said caster means is rotatable about a vertical axis and said boom is supported on pivot means disposed directly over said caster means.

5. The combination recited in claim 2 wherein said bucket has a flexible funnel means connected to the bottom,
and control means for opening said funnel means, whereby fruit from said picking bucket may be discharged into said bin.

6. The combination recited in claim 5 wherein said front wheel is supported on said frame by caster means.

* * * * *